US011361631B2

(12) United States Patent
Kujat et al.

(10) Patent No.: US 11,361,631 B2
(45) Date of Patent: Jun. 14, 2022

(54) AUTOMATED TELLER MACHINE

(71) Applicant: Wincor Nixdorf International GmbH, Paderborn (DE)

(72) Inventors: Erich Kujat, Paderborn (DE); Lutz Neubauer, Wünnenberg-Leiberg (DE)

(73) Assignee: Wincor Nixdorf International GmbH, Paderborn (DE)

( * ) Notice: Subject to any disclaimer, the term of this patent is extended or adjusted under 35 U.S.C. 154(b) by 114 days.

(21) Appl. No.: 16/869,015

(22) Filed: May 7, 2020

(65) Prior Publication Data

US 2021/0020001 A1 Jan. 21, 2021

(30) Foreign Application Priority Data

May 9, 2019 (EP) ..... 19173422

(51) Int. Cl.
*G07F 19/00* (2006.01)

(52) U.S. Cl.
CPC ..... *G07F 19/209* (2013.01); *G07F 19/205* (2013.01)

(58) Field of Classification Search
CPC ..... G07F 19/209; G07F 19/205
See application file for complete search history.

(56) References Cited

FOREIGN PATENT DOCUMENTS

| | | | | |
|---|---|---|---|---|
| DE | 102008023582 | A1 | 11/2009 | |
| DE | 102009003685 | A1 | 9/2010 | |
| DE | 102011010737 | A1 | 8/2012 | |
| WO | WO-2017209627 | A1 * | 12/2017 | ..... G06Q 20/208 |

* cited by examiner

*Primary Examiner* — Laura A Gudorf
(74) *Attorney, Agent, or Firm* — Black, McCuskey, Souers & Arbaugh LPA

(57) ABSTRACT

An automated teller machine comprises an output compartment for the output of notes of value and a closing element (14) which, in a closed state, closes the output compartment. An output area (12) is delimited by a first delimiting element (16, 22) and at least a second delimiting element (18, 20) and, in the closed state, by the closing element (14). An arrangement (110, 210, 310, 410, 510, 610) for monitoring the output area (12) comprises at least a sensor unit (112, 122, 212, 222, 512, 520, 312, 612, 712, 812) which is arranged and configured such that it detects an element (E, E1, E2) arranged in the output area.

9 Claims, 10 Drawing Sheets

AUTOMATED TELLER MACHINE

The invention relates to an automated teller machine with an output compartment for the output of notes of value, with a closing element which, in a closed state, closes the output compartment, and with an output area which is delimited by a first and at least a second delimiting element and, in the closed state, by the closing element.

The output area of automated teller machines may be manipulated by criminal third parties in the course of so-called cash trapping measures. Here, a cash trapping element which is constructed optically similarly in particular to the closing element is arranged in the output area such that a user may not take banknotes from the output compartment even when the closing element is open. The cash trapping element often gives the user the impression of a closed closing element.

From the prior art, solutions are known in which camera units monitor the automated teller machine. From document DE 10 2011 010 737 A1, it is for example known to capture with the aid of a camera an image of the automated teller machine at predetermined time intervals and/or after a movement of objects in the area in front of the automated teller machine, and to compare this image with a target image. By means of the image comparison, it may be determined whether objects have been mounted on the automated teller machine without permission.

These solutions have the disadvantage that equipping the automated teller machines with camera units involves high costs, and the image comparison has to be performed with the aid of complex image processing procedures.

It is the object of the invention to specify an automated teller machine with an arrangement for monitoring the output area, which arrangement easily and reliably recognizes objects that have been mounted in the output area without permission.

This object is solved by an automated teller machine having the features of claim 1. Advantageous developments are specified in the dependent claims.

The automated teller machine according to claim 1 comprises an arrangement for monitoring the output area with at least one sensor unit, the sensor unit being arranged and configured such that it detects an element arranged in the output area. As a result, it is achieved that an object arranged in the output area is recognized easily and reliably.

It is advantageous when the output compartment and the output area are separated from each other by the closing element in the closed state of the closing element. The output area is in particular formed by a recess in the front of the automated teller machine. As a result, an element arranged in the output area in front of the closing element is reliably detected by the sensor unit. Alternatively, the closing element may be flush with a front panel of the automated teller machine in the closed state or project outward from this front panel so that the output area does not have to be formed by a recess in the front of the automated teller machine. With the aid of the sensors, then an output area in front of the front panel of the automated teller machine is monitored to detect an element arranged in the output area.

Further, it is advantageous when the sensor unit generates a detection signal from the point in time of the detection of the element and outputs the signal to a control unit of the automated teller machine. As a result, a fast, reliable detection of the element by the automated teller machine is made possible.

It is particularly advantageous when the control unit determines a manipulation state of the automated teller machine whenever the period of time of the output of the detection signal exceeds a preset limit value and when the control unit activates the automated teller machine in an error operating mode from the determination of the manipulation state. As a result, it is achieved that the error operating mode is not triggered by a body that has been inserted into the output area with permission for a short period of time. Such a body is, for example, the hand of a user, which is inserted into the output area for removal of notes of value.

In an advantageous embodiment, an activation of the automated teller machine by a user for the output of notes of value from the output compartment is not possible in the error operating mode. Thus, it is prevented that thefts may be performed with the aid of cash trapping elements during the manipulation state of the automated teller machine.

Further, it is advantageous when the sensor unit comprises a light barrier with a transmitter and a receiver. Thus, a simple and compact structure of the sensor unit is achieved.

It is particularly advantageous when the transmitter is arranged in or behind the first delimiting element and when the receiver is arranged in or behind the second delimiting element, the transmitter and the receiver being arranged opposite to each other. As a result, an element present between the first and the second delimiting element interrupts a light beam emitted by the transmitter, the receiver detecting the interruption. As a result, a reliable detection of the element is achieved and thus a reliable monitoring of the output area. Alternatively or additionally, further sensor units may be used, such as sensors for reflection detection, which detect in particular a transit time and/or phase shift of emitted electromagnetic radiation, the transmitter and the receiver preferably being arranged directly next to each other or at a short distance in the range from 1 to 10 mm. Further, it is possible to use other sensors additionally or alternatively, such as ultrasound sensors, radar sensors, laser scanning sensors.

It is advantageous when the transmitter and the receiver are arranged in or behind the first delimiting element or in or behind the second delimiting element, the transmitter and the receiver being arranged next to each other. A reflector element which is opposite to the transmitter reflects a light beam emitted by the transmitter such that the receiver receives at least a part of the light beam, the sensor unit detecting the presence of the element when the angle of incidence and/or the amount of light or the phase position or the time differences of the light beam incident on the receiver change(s). As a result, an easy and reliable monitoring of the output area is achieved.

Further, it is advantageous when the light beam is a pulsed light beam. As a result, an easy distinction of the light beam from disturbing surrounding light is achieved so that a particularly reliable monitoring of the output area is possible. Further, the amount of light that possibly reaches the eye of a user looking into the light is reduced.

In an advantageous embodiment, the sensor unit comprises an ultrasound sensor unit for transmitting and receiving ultrasound waves. The ultrasound sensor unit is arranged in or behind the first delimiting wall, the ultrasound sensor unit outputting ultrasound waves that are reflected on a body on which the ultrasound waves are incident. The ultrasound sensor unit receives the transmitted ultrasound waves again after a time interval that is dependent on the distance between the ultrasound sensor unit and the body on which the ultrasound waves are reflected. The ultrasound sensor unit detects the element when the time interval between the transmission of the ultrasound waves and the reception of the reflected ultrasound waves is less than or equal to a preset limit value. As a result, a particularly reliable detection of the element is achieved, which can in particular not be influenced by the material of the element and/or the brightness of the surrounding.

In a further alternative embodiment, the sensor unit comprises a transmitter for outputting a laser beam and a receiver for receiving the laser beam. The transmitter and the receiver are arranged in or behind the first delimiting element or the second delimiting element, the transmitter and the receiver being arranged next to each other. The laser beam is reflected on a reflector element which is arranged opposite to the transmitter. The laser beam output by the transmitter is received by the receiver within a time interval that is dependent on the distance between the sensor unit and the reflector element. The sensor unit detects the element when the time interval between transmitting the laser beam and receiving the laser beam deviates from the time interval that corresponds to a reflection of the laser beam on the reflector element. As a result, in particular a precise detection of the element in the output area is achieved. Further, an assembly having a reduced cabling effort is made possible, since the transmitter and the receiver are arranged next to each other.

It is particularly advantageous when the reflector element is arranged on the first delimiting element or the second delimiting element or when the reflector element is integrated in the first or in the second delimiting element or when the first delimiting element or the second delimiting element forms the reflector element. As a result, a reliable monitoring of the output area is achieved.

Further, it is advantageous when the reflector element is arranged on the closing element or when the closing element forms the reflector element. As a result, a reliable detection of the element in the output area is achieved.

In an advantageous embodiment, the sensor unit is formed such that in an open state of the closing element it does not detect whether an element is arranged in the output area. Thus, it is prevented that the detection signal is output every time the closing element is opened.

In a further advantageous embodiment, the sensor unit is a first sensor unit. At least a second sensor unit is provided, the control unit activating the automated teller machine in an error operating mode when the first sensor unit outputs a first detection signal and the second sensor unit outputs a second detection signal and when the period of time of the output of the first detection signal and of the second detection signal exceeds a preset limit value. As a result, it is prevented that an element placed in the output area by mistake and triggering the detection signal of a sensor unit may result in an error operating mode of the automated teller machine.

In a particularly advantageous embodiment, the transmitter and the receiver are arranged next to each other in or behind the first delimiting element, in particular at a distance to the closing element from 0 mm to 30 mmm, preferably from 3 mm to 10 mm, in particular of 5 mm. In another advantageous embodiment, the transmitter is arranged in or behind the first delimiting element at a distance to the closing element from 0 mm to 30 mm, preferably from 3 mm to 10 mm, in particular of 5 mm. The receiver is arranged opposite to the transmitter in or behind the second delimiting element at a distance from outside from 0 mm to 30 mm, preferably from 3 mm to 10 mm, in particular from 5 mm.

Further features and advantages result from the following description which explains embodiments in more detail in connection with the enclosed figures.

Figure 1:
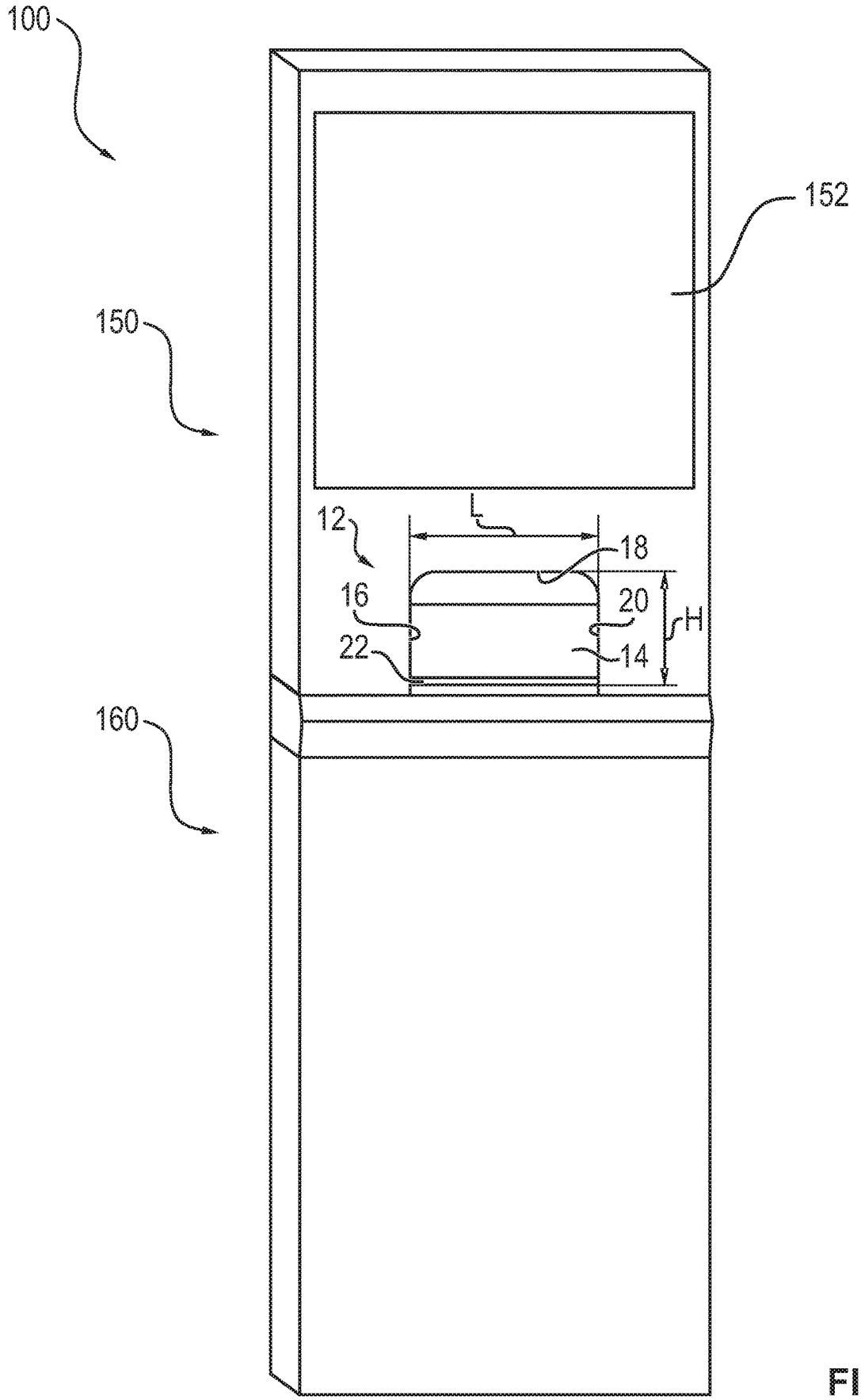
FIG. 1 shows a schematic illustration of an automated teller machine.

FIG. 1 shows a schematic illustration of an automated teller machine 100 with a head module 150 and a safe module 160. Inside the head module 150, a value note handling unit (not visible in FIG. 1) for the output of notes of value to be dispensed to a user is arranged. In the safe module 160, several non-illustrated cash boxes may be accommodated. Via a display unit 152 in the head module 150, in particular user information may be output to the user. The head module 150 comprises an output area 12 which is delimited by four delimiting walls 16, 18, 20 and 22 and, in the closed state illustrated in FIG. 1, by a closing element 14, also referred to as a shutter. The distance L between the delimiting walls 16 and 20 in particular has a value in the range from 18 cm to 25 cm. The distance H between the delimiting walls 22 and 18 in particular has a value in the range from 8 cm to 25 cm. In FIG. 1, the shutter 14 is illustrated in a closed state.

Behind the closed shutter 14, an output compartment, not visible in FIG. 1, is arranged in which a note of value or a value note stack for removal by the user is provided. After providing the note of value or the value note stack in the output compartment, the shutter 14 is moved from the closed position shown in FIG. 1 into an open position with the aid of a non-illustrated drive unit, in which open position the user has access to the output compartment and the notes of value present therein through the output area 12. In the closed state of the shutter 14, the output compartment is arranged on the one side and the output area 12 is arranged on the other side of the shutter 14.

Figure 2:
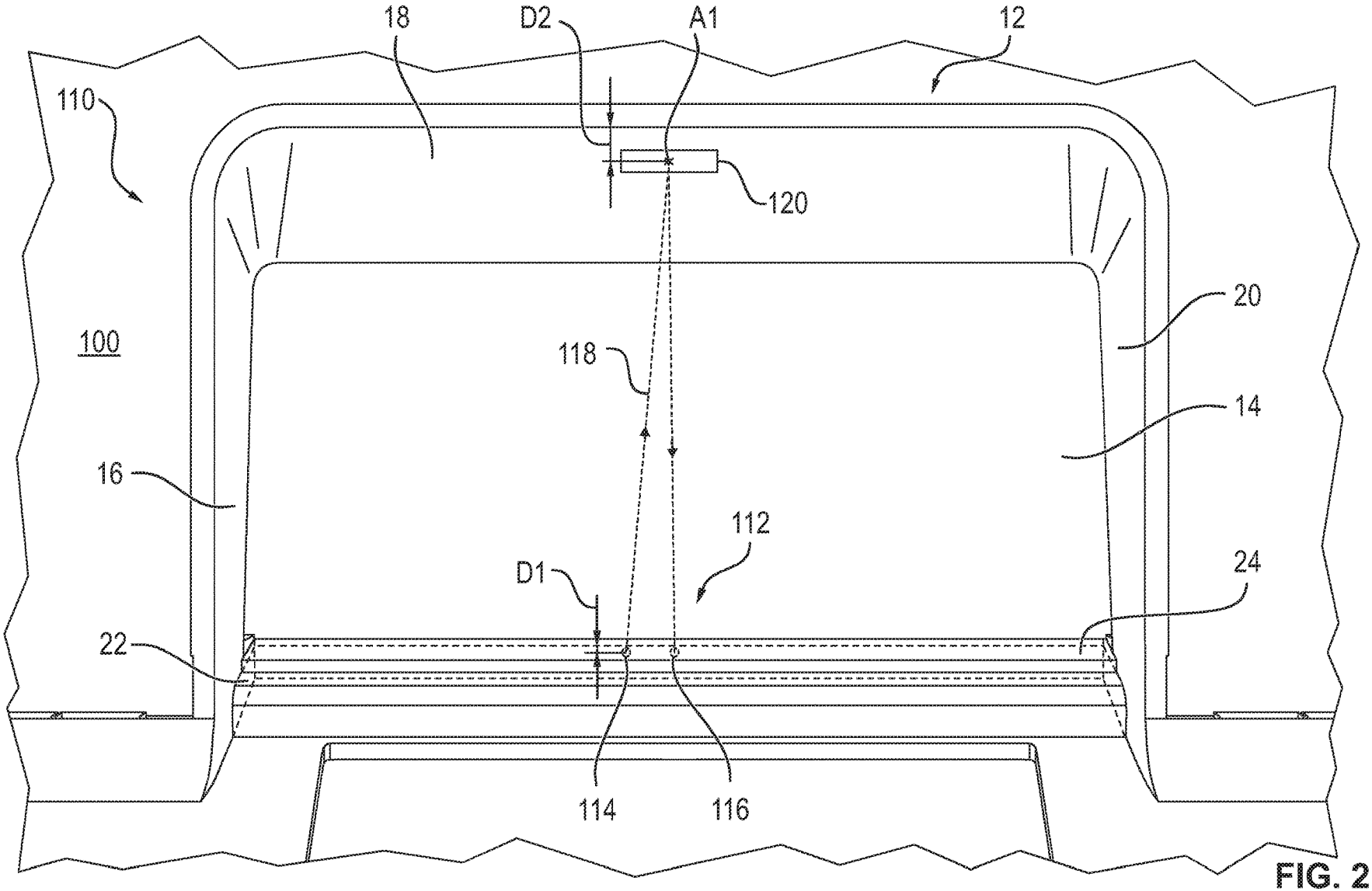
FIG. 2 shows an arrangement for monitoring an output area of the automated teller machine of FIG. 1 according to a first embodiment.

FIG. 2 shows an arrangement 110 for monitoring the output area 12 of the automated teller machine 100 according to a first embodiment. The lower delimiting wall 22 comprises an area 24 permeable to light, in particular to visible or non-visible light. In an alternative embodiment, the entire delimiting wall 22 may be made of a light-transmitting material. Alternatively, also all delimiting walls 16, 18, 20, 22 may be made of a light-transmitting material. In or behind the delimiting wall 22, a sensor unit 112 is arranged, which is configured as a reflection light barrier. The sensor unit 112 comprises a transmitter 114 and a receiver 116, which are arranged next to each other. In other embodiments, additionally or alternatively a reflection light barrier may be provided, the emitted light of which is not reflected to the receiver of the light barrier without an element arranged in the output area, but only when an element is arranged in the output area. Thus, the detection of the element is achieved with the aid of the transmitted light principle.

A light beam 118 emitted by the transmitter 114 is reflected back to the receiver 116 on a reflector 120 which is integrated in the delimiting wall 18 opposite to the delimiting wall 22. The reflector 120 has a reflectance, i.e. a ratio between reflected radiation and incident radiation of at least 50%. As a reflector 120, in particular a retroreflective foil is used. Retroreflective foils may have a reflective background in which small glass balls having a size of about 50 μm are embedded. For covering or disguising, these are in particular covered with a colored foil. In an alternative embodiment, the delimiting wall 18 is configured or coated such that, without a specific reflector, it has a sufficient reflective property for reflecting the light beam 118 so that it reaches the receiver 116.

In FIG. 2, for easy representation, only one point of reflection A1 is shown, on which the light beam 118 is reflected. In practice, the light beam 118 is reflected on a surface which is dependent on the concentration of the emitted light beam 118. After reflection of the light beam 118 on the reflector 120, at least a part of the reflected light beam 118 is incident on the receiver 116, which detects the incident reflected light of the light beam 118. The sensor unit 112 is in particular arranged at a distance D1 to the shutter 14 from 0 mm to 5 mm, preferably from 3 mm to 10 mm, in particular of 5 mm. The sensor unit 112 is further arranged and oriented such that the point of reflection A1 in particular has a distance D2 from outside from 0 mm to 50 mm, preferably from 5 mm to 10 mm, in particular of 5 mm.

The arrangement of an element in the output area 12 between the sensor unit 112 and the reflector 120 causes an interruption of the light beam 118, which interruption is detected by the receiver 116. From the point in time of the detection of the interruption, the sensor unit 112 generates a detection signal and transmits the detection signal to a control unit of the automated teller machine 100. In the normal operating mode of the automated teller machine 100, the light beam 118 is only interrupted for short periods of time in the range from 1 to 10 seconds, for example during the removal of notes of value from the output area by the user.

Figure 9:
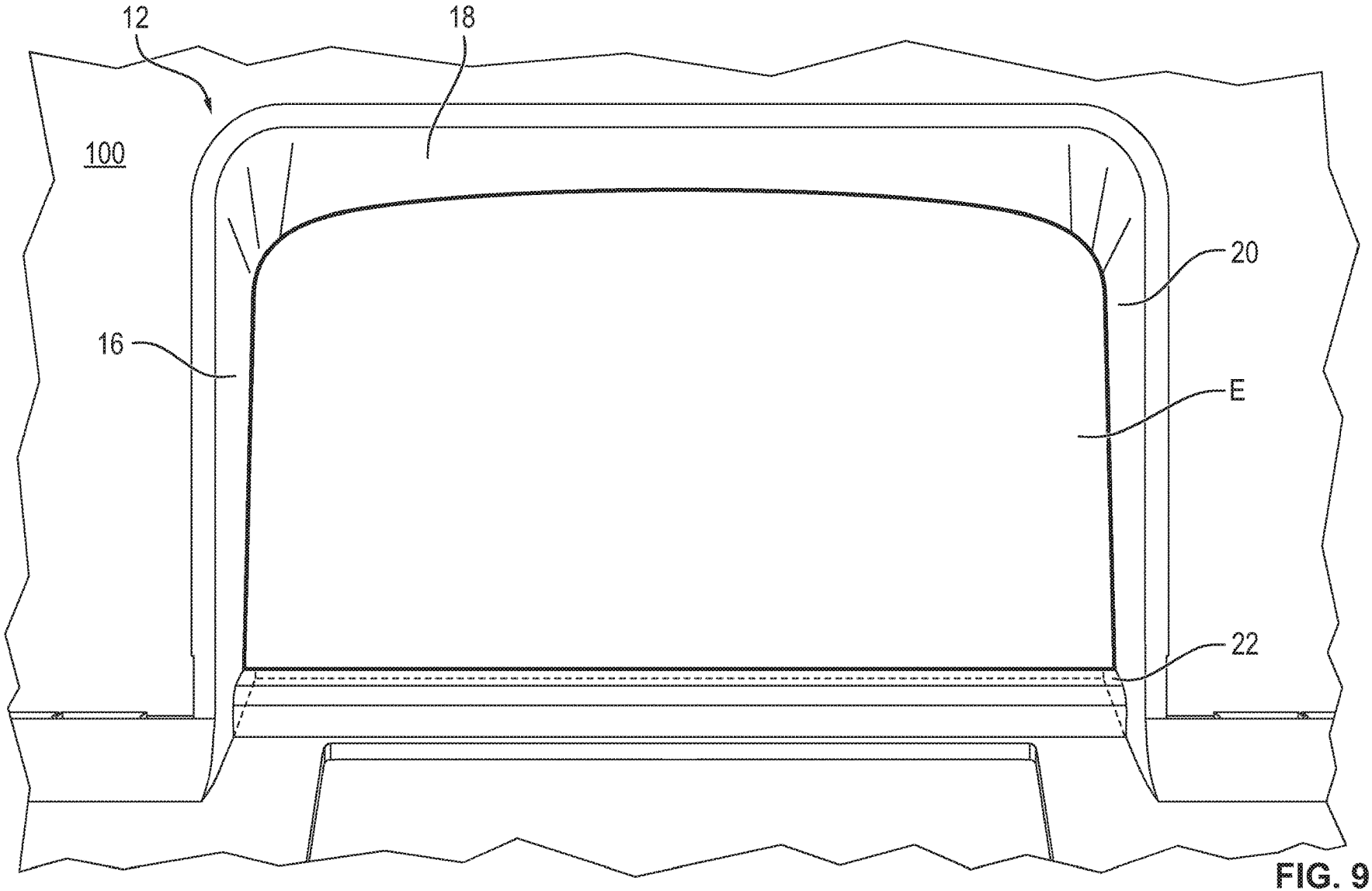
FIG. 9 shows the automated teller machine according to FIG. 1 in a state in which a cash trapping element is arranged in the output area.

The light beam 118 may however also be interrupted when criminal third parties manipulate the output area 12, for example in the course of so-called cash trapping measures. In the so-called external cash trapping measures, a cash trapping element is arranged in the output area 12. This cash trapping element is optically similarly constructed in particular to the shutter 14 and covers the shutter 14 such that a user may not remove notes of value from the output compartment even when the shutter 14 is opened. The cash trapping element often gives the user the impression of a closed shutter 14. FIG. 9 shows the automated teller machine 100 in a state in which a cash trapping element E is arranged in the output area 12 and covers the shutter 14.

Known cash trapping elements E comprise means which prevent a closing of the open shutter 14 behind the cash trapping element E. Alternatively or additionally, the cash trapping elements comprise means to which one or more notes of value provided in the output compartment adhere. When the automated teller machine 100 is activated by the user for the output of notes of value, indeed the shutter 14 opens, the cash trapping element E however prevents the access to the output compartment. As soon as the user leaves the automated teller machine 100, the criminal third parties remove the cash trapping element E from the output area 12 and thus gain access to the notes of value.

In the described manipulation of the automated teller machine 100 with the aid of the cash trapping element E, the light beam 118 of the senor unit 112 is interrupted over a longer period of time, in the range of minutes or hours. The period of time, during which the detection signal is transmitted to the control unit, i.e. during which the light beam 118 is interrupted, is thus an indicator for a manipulation state of the automated teller machine 100. The manipulation state is in particular determined when the period of time of the transmission of the detection signal to the control unit exceeds a preset limit value, for example in the range between 1 minute and 5 minutes.

Figure 3:
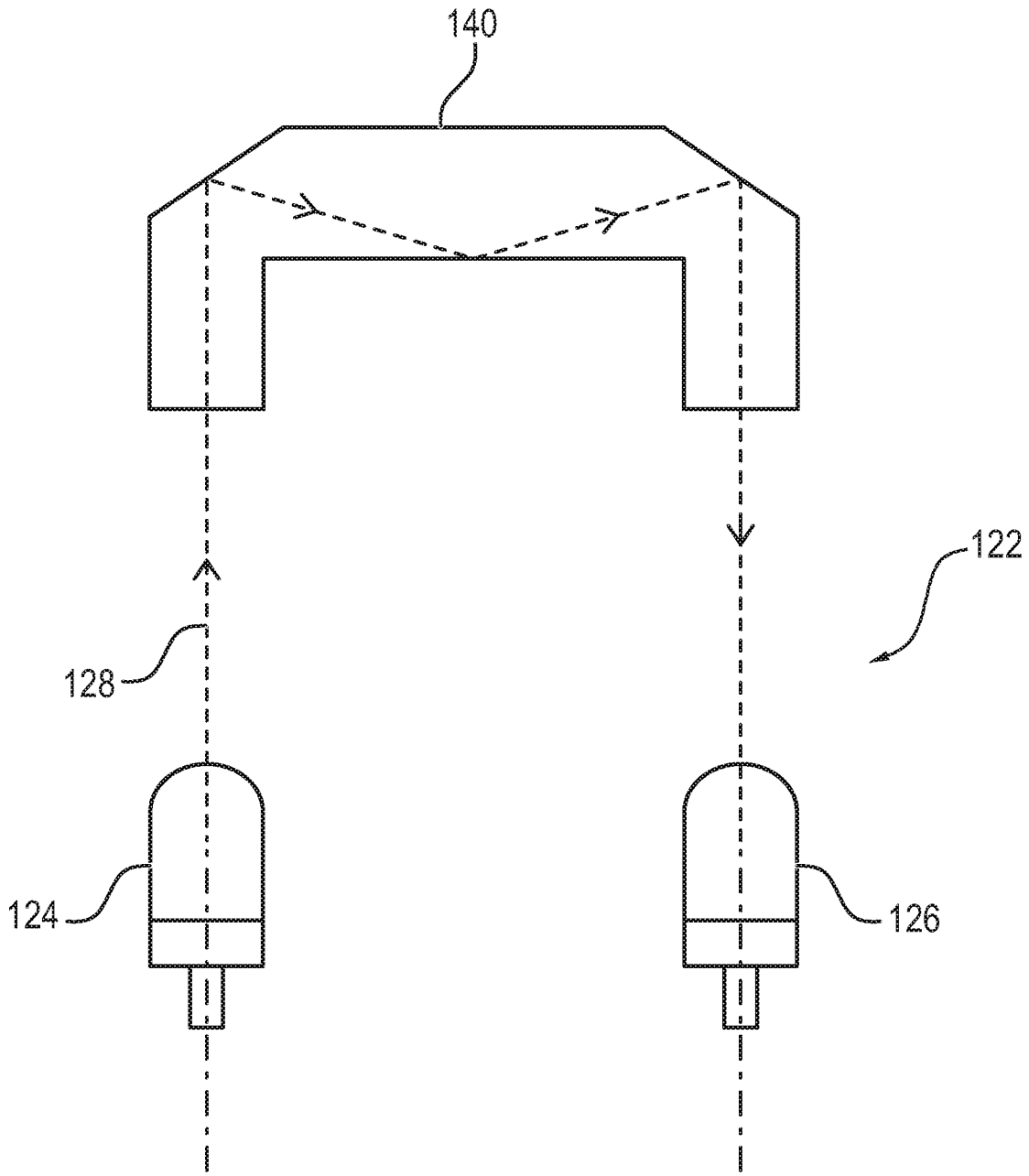
FIG. 3 shows a schematic illustration of a sensor unit which may be arranged in the output area alternatively or additionally to the sensor unit of FIG. 2.

FIG. 3 shows a schematic illustration of a sensor unit 122, which may be arranged alternatively or additionally to the sensor unit 112 in the output area 12. The sensor unit 122 is likewise formed as a reflection light barrier and differs from the sensor unit 112 in that the light beam 128 is not deflected on a reflector foil but on a prism arrangement 140 formed as a reflector element. The transmitter 124 and the receiver 126 are arranged in or behind the lower delimiting wall 22, and the prism arrangement 140 is arranged in or behind the opposite delimiting wall 18. The prism arrangement 140 deflects the light beam 128 emitted by the transmitter 124 so that at least a part of the light beam 128 is received by the optical receiver 126. When a body is present between the sensor unit 122 and the prism arrangement 140, the light beam 128 is interrupted.

Figure 4:
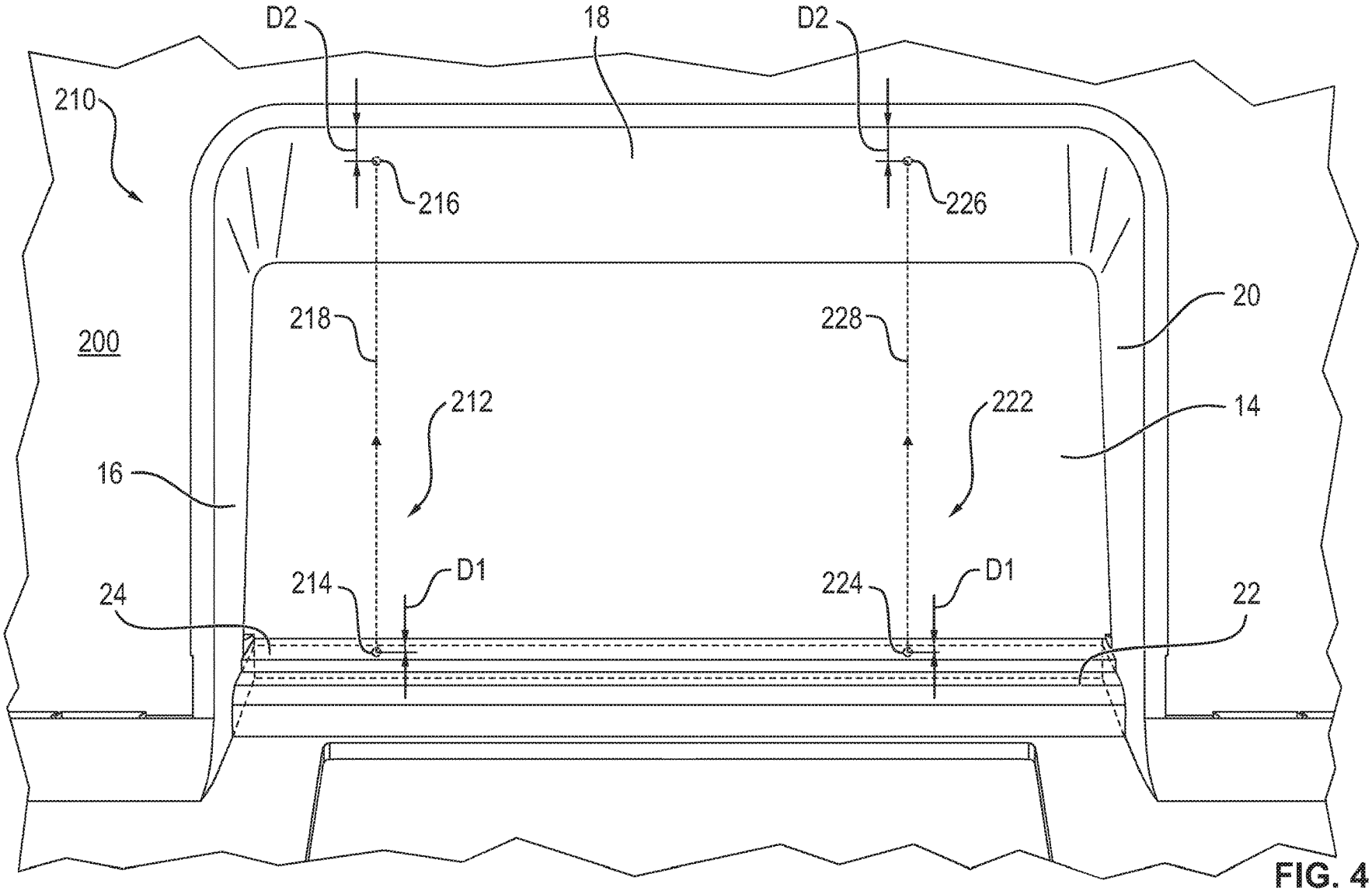
FIG. 4 shows an arrangement for monitoring the output area according to a second embodiment.

FIG. 4 shows an arrangement 210 for monitoring an output area 12 of an automated teller machine 200 according to a second embodiment. Elements having the same structure and the same function are identified with the same reference signs. Two sensor units 212, 222, which are formed as one-way light barriers, are arranged in or behind the delimiting wall 22. The sensor units 212, 222 each comprise a transmitter 214, 224 integrated in or behind the lower delimiting wall 22 and a receiver 216, 226 which is opposite to the transmitter 214, 224 and arranged in or behind the delimiting wall 18. The transmitters 214, 224 each emit a light beam 218, 228 which is detected by the receiver 216, 226.

In the embodiment of FIG. 4, the sensor units 212, 222 each generate a detection signal as soon as an interruption of the respective light beam 218, 228 is detected. As explained in connection with the first embodiment, the manipulation state is determined dependent on the period of time of the detection signal, wherein in the second embodiment the manipulation state is determined when the period of time of the transmission of both detection signals exceeds the preset limit value, for example in the range between 1 minute and 5 minutes. As a result, it is in particular prevented that an object which has accidentally been deposited on the delimiting wall 22 by the user and only interrupts one of the two light beams 118, 218, triggers a detection of the manipulation state of the automated teller machine 200.

Figure 5:
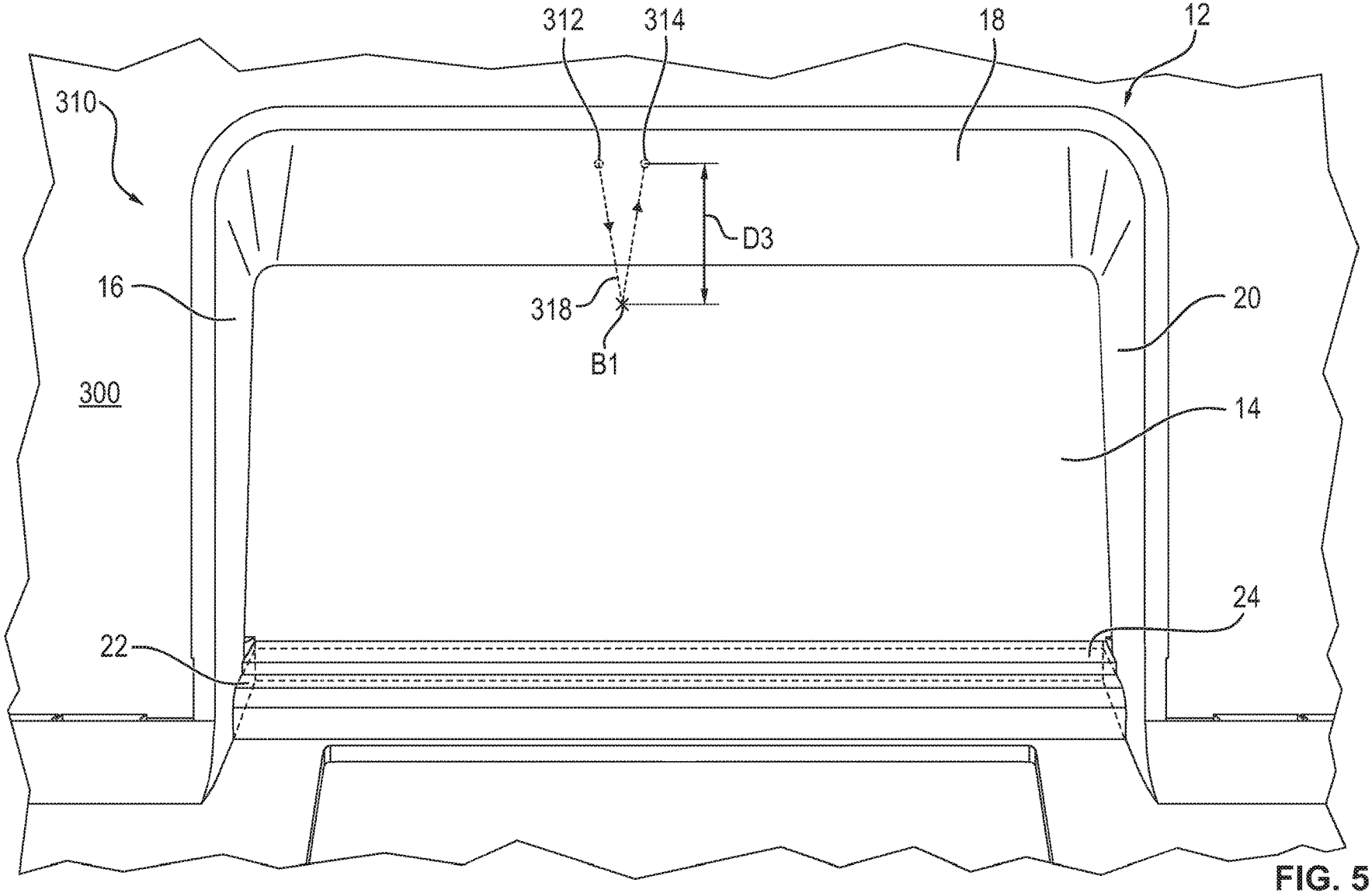
FIG. 5 shows an arrangement for monitoring the output area according to a third embodiment.

FIG. 5 shows an arrangement 310 for monitoring an output area 12 of an automated teller machine 300 according to a third embodiment. The arrangement 310 comprises a glare sensor unit 312 with a transmitter 314 for transmitting a light beam 318 and a receiver 316 for receiving the light beam 318. As a glare sensor unit 312, for example, a glare sensor unit of the product family Glare of the manufacturer SICK may be used. The glare sensor unit 312 is arranged in or behind the delimiting wall 18 such that the glare sensor unit 312 has a distance D3 to the shutter 14, which in particular has a value in the range from 4 cm to 8 cm, preferably of 5 cm.

The light beam 318 emitted by the transmitter 314 is reflected on the shutter 14. For simplified presentation, here too a point of reflection B1 is indicated. The glare sensor unit 312 is configured to recognize the glare of the surface on which the light beam 318 is reflected. An element for manipulating the output area 12, in particular a cash trapping element E, is usually a plastic element which is indeed modelled after the closing element 14, but does not have the same reflective properties. When the light beam 318 is not reflected on the shutter 14, but on a cash trapping element E arranged in front of the shutter 14, the glare sensor unit 312 detects a change in the glare properties and outputs a detection signal to the control unit from the time of detection. The control unit detects the manipulation state of the automated teller machine 300 when the period of time of the transmission of the detection signal to the control unit exceeds the preset limit value, for example in the range between 1 minute and 5 minutes.

Figure 6:
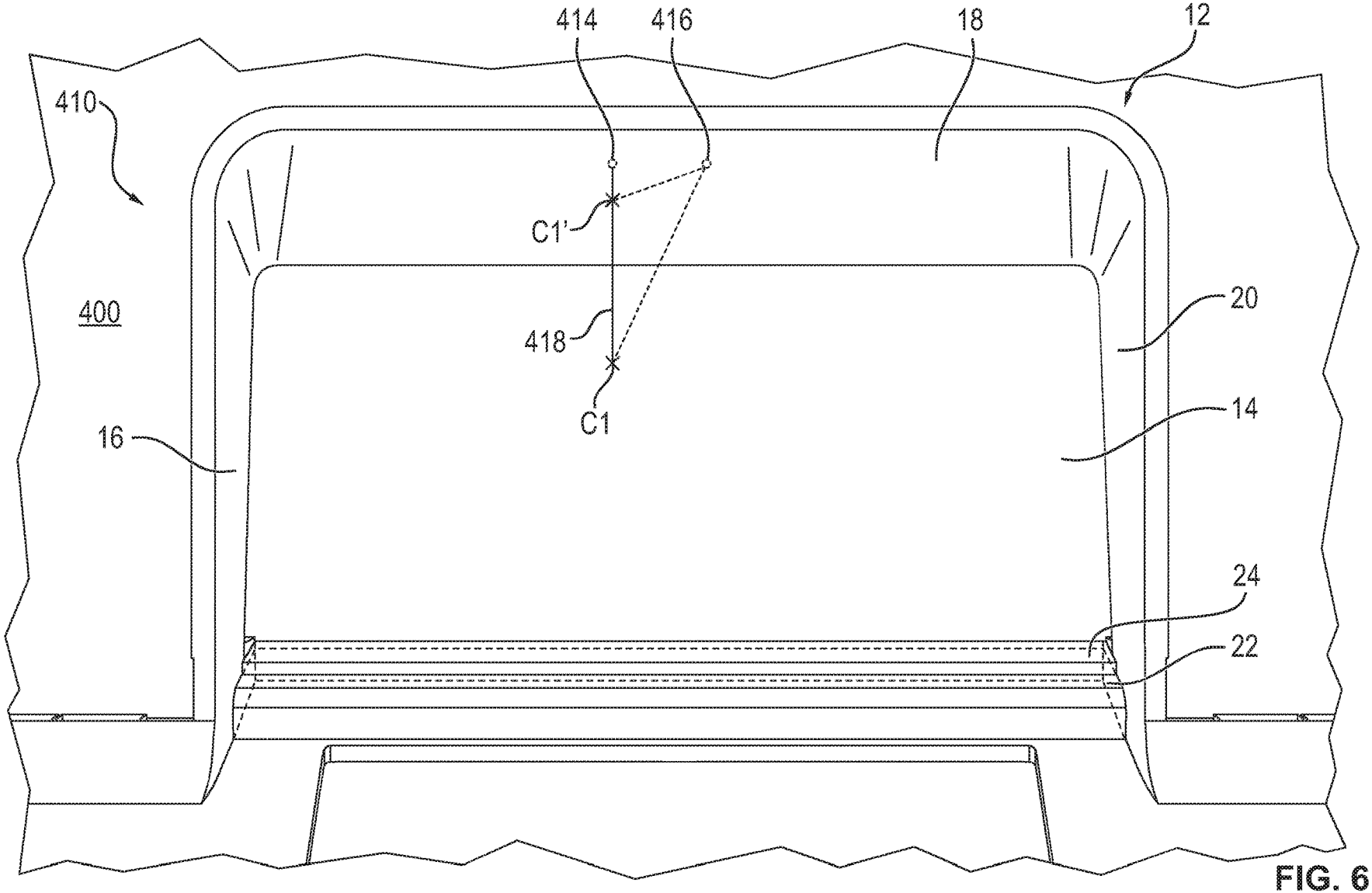
FIG. 6 shows an arrangement for monitoring the output area according to a fourth embodiment.

FIG. 6 shows an arrangement 410 for monitoring an output area 12 of an automated teller machine 400 according to a fourth embodiment. The arrangement 410 for monitoring the output area 12 comprises a sensor unit 412 with a transmitter 414 arranged in or behind the delimiting wall 18 and with a photo receiver 416. The transmitter 414 outputs a continuous or pulsed laser beam or alternatively or additionally IR beams/radar waves 418, which is incident on a point of incidence C1 on the shutter 14. The position of the point of incidence C1 is determined by the photo receiver 416 arranged next to the transmitter 414, in particular with the aid of a spatially resolving photodiode or with the aid of a CCD line or alternatively or additionally with the aid of an IR diode or a radar sensor. When a cash trapping element E of FIG. 9 is arranged in the output area 12, the point of incidence C1' is not on the shutter 14 but on the cash trapping element E so that the respective angles of incidence under which the points of incidence C1, C1' are observed by the photo receiver 416 are different. From the point in time of the detection of the changed angle of incidence, the sensor unit 412 outputs a detection signal. The control unit determines the manipulation state of the automated teller machine 400 when the period of time of the transmission of the detection signal to the control unit exceeds the preset limit value, for example in the range between 1 minute and 5 minutes.

In alternative embodiments, a measurement of the distance between a sensor unit which is configured to output a laser beam, an IR beam or radar waves, and a predetermined target point, in particular on the shutter 14 may be performed. The distance may be measured via a transit time measurement or a phase position measurement. In the case of the transit time measurement, the transmitter emits a light pulse. The time which the light pulse requires to reach from the transmitter to a reflective body, in particular a retroreflector arranged on the shutter 14, and back again to the transmitter, is generally referred to as pulse transit time. With the aid of the pulse transit time and the speed of light, the distance between the transmitter and the reflector is determined. In the case of a phase position measurement, on the other hand, a phase shift of the reflected laser beam as compared to the emitted laser beam is determined. With the aid of the phase shift, the covered distance is determined. When an element, in particular a cash trapping element E is arranged between the sensor unit and the shutter 14, the pulse transit time or the phase shift changes, the change being detected by the sensor unit which from the point in time of the detection outputs a detection signal. Also when using radar sensors, ultrasound sensors, light barriers etc. a phase shift and/or a pulse transit time may be determined.

Figure 7:
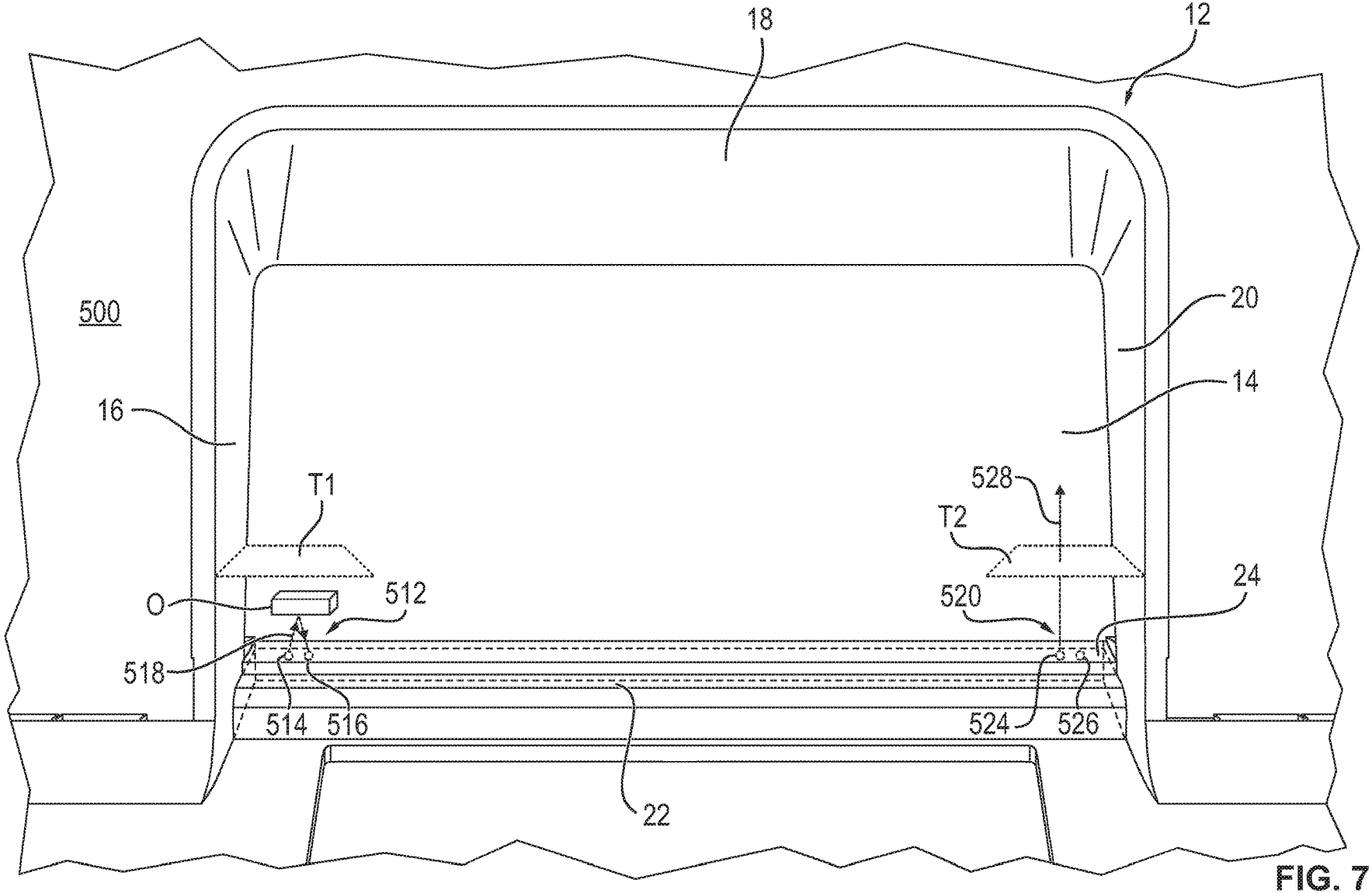
FIG. 7 shows an arrangement for monitoring the output area according to a fifth embodiment.

FIG. 7 shows an embodiment with two sensor units 512 and 520, which are designed as reflection light sensor units. The sensor units 512 and 520 each comprise a transmitter 514, 524 and a receiver 516, 526 which are arranged in or behind the delimiting wall 22. The transmitters 514, 524 each output a light beam 518, 528. A scanning plane T1 delimits the maximum range of the sensor unit 512, the scanning plane T2 delimits the maximum range of the sensor unit 520. In FIG. 7, for ease of explanation, an object O is arranged between the scanning plane T1 and the sensor unit 512. The light beam 518 is reflected on the object O and received by the receiver 516 which outputs a detection signal to the control unit. The light beam 528 of the sensor unit 520 is, on the other hand, not reflected between the scanning plane T2 of the sensor unit 520 so that the sensor unit 520 does not output a detection signal to the control unit. The control unit determines the manipulation state of the automated teller machine 500 in particular when both sensor units 512, 520 output a detection signal and when the period of time of the transmission of the two detection signals to the control unit exceeds the present limit value, for example in the range between 1 minute and 5 minutes.

Figure 8:
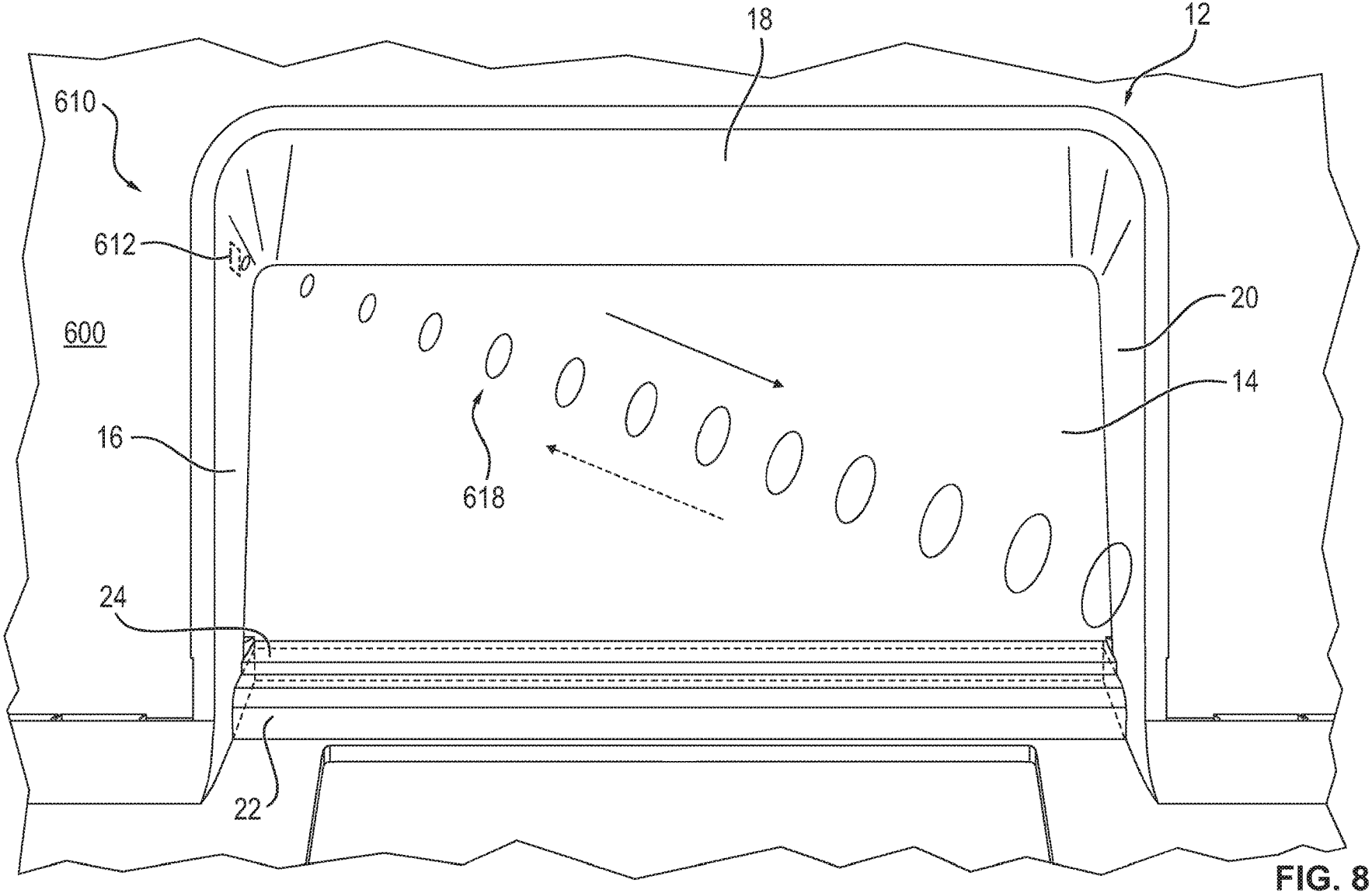
FIG. 8 shows an arrangement for monitoring the output area according to a sixth embodiment.

FIG. 8 shows an embodiment in which the arrangement 610 for monitoring the output area 12 comprises an ultrasound sensor unit 612 for transmitting and receiving ultrasound waves 618. The ultrasound sensor unit 612 is arranged in or behind the delimiting wall 16 and outputs ultrasound waves 618. The ultrasound sensor unit 612 is arranged such that the ultrasound waves 618 propagate within the output area 12 and are reflected on the delimiting wall 20.

The emitted ultrasound waves 618 are again received by the ultrasound sensor unit 612 after a time interval which is dependent on the distance between the ultrasound sensor unit 612 and an element on which the ultrasound waves 618 are reflected. In a normal state of the automated teller machine 600, i.e. in a state without an arrangement of a body in the output area 12, the ultrasound waves 618 are received after the time interval that corresponds to the reflection on the delimiting wall 20.

The arrangement of the cash trapping element E in the output area 12 has the consequence that the ultrasound waves 618 are at least partially reflected by the cash trapping element E after a time interval that is shorter than the time interval upon reflection of the ultrasound waves 618 on the delimiting wall 20. This time difference or, additionally or alternatively, a quantitative deviation of the amplitude of the reflection signal is detected by the ultrasound senor unit 612 which outputs a detection signal to the control unit from the point in time of the detection. The control unit determines the manipulator state of the automated teller machine 600 when the period of time of the transmission of the detection signal to the control unit exceeds the preset limit value, for example in the range between 1 minute and 5 minutes.

In an alternative embodiment, the ultrasound sensor unit 612 is integrated in the shutter 14. In the normal operating state of the automated teller machine, i.e. in a state with a cash trapping element E arranged in the output area 12, the ultrasound waves are in particular only reflected when the user operates the automated teller machine. The arrangement of a cash trapping element E in the output area 12 has the consequence that the ultrasound waves 618 reflected by the cash trapping element are again detected after a time interval that is shorter than the time interval that corresponds to the reflection of the ultrasound waves 618 on the user. This time difference is detected by the ultrasound sensor unit 612, which outputs a detection signal to the control unit from the point in time of the detection. The control unit determines the manipulator state of the automated teller machine 600 when the period of time of the transmission of the detection signal to the control unit exceeds the preset limit value, for example in the range between 1 minute and 5 minutes.

FIG. 9 exemplarily shows the automated teller machine 100 in a state in which the cash trapping element E is arranged in the output area 12 and covers the shutter 14.

Figure 11:
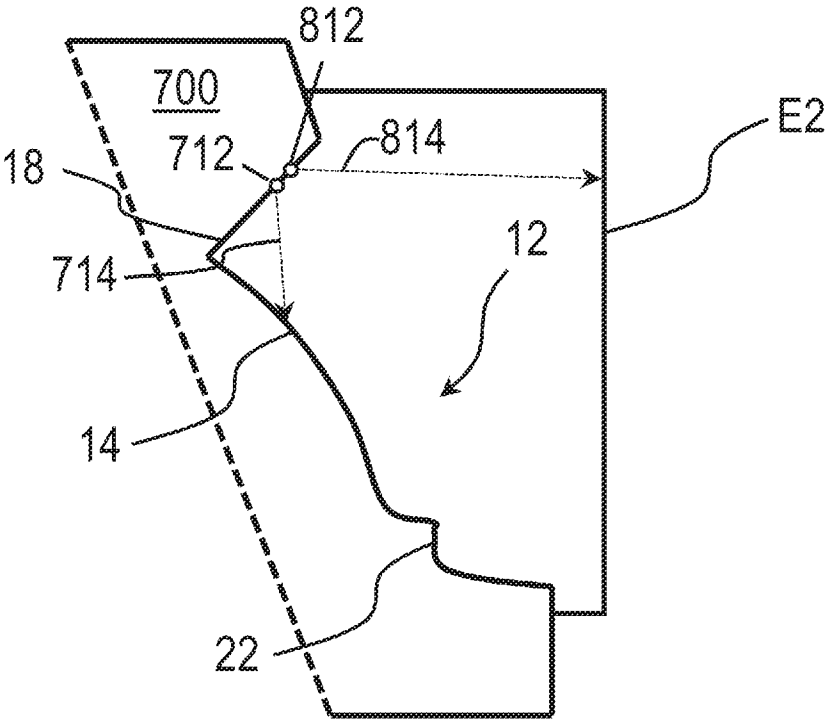
FIG. 11 shows the automated teller machine of FIG. 10 with an alternative box-shaped embodiment of the cash trapping element.
Figure 10:
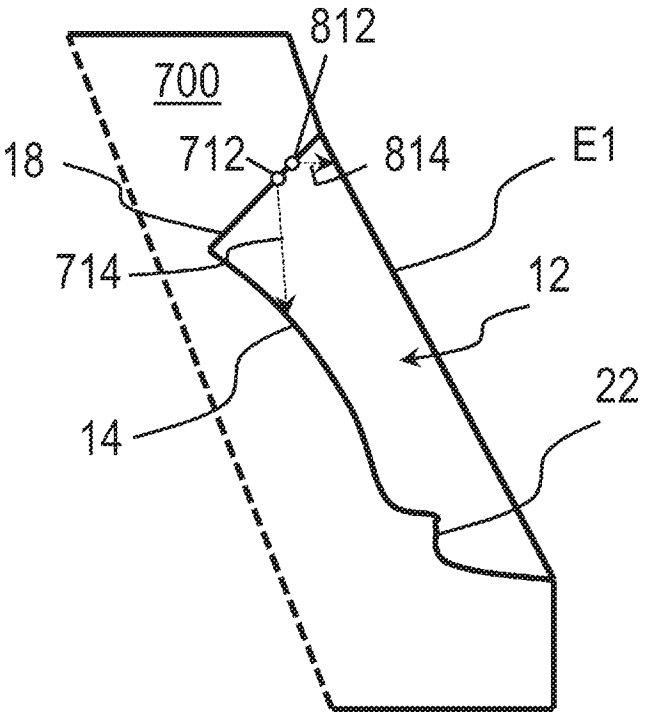
FIG. 10 shows a schematic cross-section of an automated teller machine with a further embodiment of a cash trapping element.

FIG. 10 shows a schematic cross-section of the automated teller machine 700 with a further embodiment of the cash trapping element E1. The cash trapping element E1 is a substantially straight cover plate which is arranged in front of the shutter 14 such that the output area 12 is covered in a form-closing manner by the cash trapping element E1. The cash trapping element E1 is in this case preferably arranged flush with the front panel of the automated teller machine 100. FIG. 11 shows the automated teller machine 700 with an alternative box-shaped embodiment of the cash trapping element E2, which is arranged as a projecting structure in front of the output area 12.

The automated teller machine 700 comprises a first sensor unit 712 and a second sensor unit 812. The first sensor unit 712 is arranged such that a cash trapping element E, E1, E2 arranged in the output area 12 is detected in a sensing area of the sensor unit 712, the direction of the extension of the sensing area of the sensor unit 712 being identified with the arrow 714 oriented toward the shutter 14. The second sensor unit 812 is, on the other hand, arranged such that a form-closing cash trapping element E1 or a box-shaped cash trapping element E2 is detected in a sensing area of the sensor unit 812, the direction of the extension of the sensing area of the sensor unit 812 being identified with the outward pointing arrow 814.

According to the above-described embodiments, the sensor units 712, 812 may each be configured as a reflection light barrier, as a one-way light barrier, as glare sensor units, as a sensor unit for the output and the detection of a continuous or pulsed laser beam, as a sensor unit for the output and the detection of IR beams/radar waves and/or as an ultrasound sensor unit.

In a preferred embodiment, the sensor units 112, 122, 212, 222, 312, 512, 520, 612 are not activated when the shutter 14 is open. As a result, it is in particular prevented that upon each cash removal a detection signal is generated. In a particularly preferred embodiment, two or more described embodiments are combined with each other.

In an alternative embodiment, alternatively or additionally to the described sensor units, brightness sensors may be used. Preferably, a first brightness sensor is integrated in the shutter 14, and a second brightness sensor is arranged outside the output area 12. The brightness sensors transmit measuring values of the ambient brightness to the control unit. The control unit compares the brightness curve of the first brightness sensor and that of the second brightness sensor and determines the manipulation state when the period of time during which the measuring values exceeds the preset limit value, for example in the range between one minute and five minutes.

Preferably, an arrangement behind the delimiting wall 16 to 22 is an arrangement on the side of the delimiting wall 16 to 22 facing away from the output area 12.

In a particularly preferred embodiment, the control unit controls the automated teller machine 100, 200, 300, 400, 500, 600 in an error operating mode as from the point in time of the determination of the manipulation state. In the error operating mode, the automated teller machine 100, 200, 300, 400, 500, 600 cannot be activated for the output of notes of value by the user. In a preferred embodiment, the automated teller machine 100, 200, 300, 400, 500, 600 may automatically be switched off from the point in time of the determination of a manipulation state, and an error message is output to a central control unit of the bank or a service provider.

LIST OF REFERENCE SIGNS

12 output area
14 shutter
16, 18, 20, 22 delimiting wall
24 light-transmitting area
100, 200, 300, 400, 500, 600 automated teller machine
110, 210, 310, 410, 510, 610 arrangement
112, 122, 212, 222, 512, 520,
312, 612, 712, 812 sensor unit
114, 124, 214, 224, 314, 414
514, 524 transmitter
116, 126, 216, 226, 316, 416,
516, 526 receiver
118, 128, 218, 228, 318, 518,
528 light beam
120 reflector
140 prism arrangement
150 head module
160 safe module
418 laser beam
618 ultrasound waves
714, 814 arrow
A1, B1 point of reflection
C1, C1' point of incidence
D1, D2 distance
E, E1, E2 cash trapping element
O object
T1, T2 scanning plane

The invention claimed is:

1. An automated teller machine comprising:
an output compartment for the output of notes of value;
a closing element which, in a closed state, closes the output compartment;
an output area which is delimited by a first delimiting element and at least a second delimiting element and the closing element, when the closing element is in the closed state;
an arrangement for monitoring the output area with at least one sensor unit arranged and configured to detect an element arranged in the output area
wherein the at least one sensor unit includes:
a transmitter configured to emit at least one of ultrasound waves and a light beam,
a reflector element configured to reflect the at least one of ultrasonic waves and the light beam emitted by the transmitter, and
a receiver configured to receive reflected at least one of ultrasonic waves and the light beam;
wherein the reflector element is one of arranged on the closing element or formed by the closing element.

2. The automated teller machine according to claim 1, wherein the output compartment and the output area are separated from each other by the closing element in the closed state of the closing element.

3. The automated teller machine according to claim 1, wherein the sensor unit generates a detection signal from a point in time of the detection of the element and output the detection signal to a control unit of the automated teller machine.

4. The automated teller machine according to claim 3, wherein the control unit determines a manipulation state of the automated teller machine when a period of time of the output of the detection signal exceeds a preset limit value and that the control unit controls the automated teller machine in an error operating mode from the determination of the manipulation state.

5. The automated teller machine according to claim 4, wherein in the error operating mode an activation of the automated teller machine by a user for the output of notes of value from the output compartment is not possible.

6. The automated teller machine according to claim 1 wherein the transmitter and the receiver are arranged in or behind the first delimiting element or the second delimiting element, the transmitter and the receiver being arranged next to each other, the reflector element opposite to the transmitter, the at least one sensor unit detecting the presence of the element when an angle of incidence of the light beam on the receiver changes.

7. The automated teller machine according to claim 1 wherein the transmitter is further defined as configured to emit the light beam the light beam is further defined as a pulsed light beam.

8. The automated teller machine according to claim 1 wherein the transmitter is further defined as configured to emit the ultrasound waves.

9. The automated teller machine according to claim 1 wherein the transmitter is further defined as configured to emit the light beam in the form of a laser beam.

* * * * *